United States Patent [19]

Morduchowitz et al.

[11] Patent Number: 4,789,451

[45] Date of Patent: Dec. 6, 1988

[54] MEANS FOR REDUCING OXALIC ACID TO A PRODUCT

[75] Inventors: Abraham Morduchowitz, Monsey, N.Y.; Anthony F. Sammells, Naperville, Ill.

[73] Assignee: Texaco Inc., White Plains, N.Y.

[21] Appl. No.: 771,958

[22] Filed: Sep. 3, 1985

Related U.S. Application Data

[62] Division of Ser. No. 724,707, Apr. 18, 1985.

[51] Int. Cl.[4] ..... C25B 9/00

[52] U.S. Cl. ..... 204/275; 204/292; 204/294

[58] Field of Search ..... 204/257, 262, 275, 294, 204/292, 73 R, 76

[56] References Cited

U.S. PATENT DOCUMENTS

| | | | |
|---|---|---|---|
| 3,169,913 | 2/1965 | Wright | 204/262 |
| 4,177,116 | 12/1979 | DeNora et al. | 204/263 |
| 4,280,883 | 7/1981 | Raetzsch | 204/262 |
| 4,417,959 | 11/1983 | Kadija et al. | 204/263 |
| 4,530,743 | 7/1985 | De Nora | 204/263 |

*Primary Examiner*—R. L. Andrews

*Attorney, Agent, or Firm*—Robert A. Kulason; James J. O'Loughlin; Ronald G. Gillespie

[57] ABSTRACT

Apparatus for reducing oxalic acid to a product includes a cell. A separator which separates the cell into two chambers; a catholyte chamber and an anolyte chamber. Each chamber has an inlet and an outlet. A porous cathode having a catalyst is arranged within the catholyte chamber so that a catholyte entering the inlet of the catholyte chamber will pass through the cathode. A porous anode is arranged within the anolyte section so that an electrolyte entering the inlet of the anolyte section will pass through the anode and exit through the outlet of anolyte section. A source provides the catholyte which is a mixture of oxalic acid and an electrolyte to the inlet of the catholyte chamber while another source provides the electrolyte to the inlet of the anolyte chamber. A d.c. voltage is provided between the cathode and the anode so as to cooperate in the reduction of oxalic acid within the porous cathode to a product which exits the catholyte chamber by way of its outlet.

8 Claims, 1 Drawing Sheet

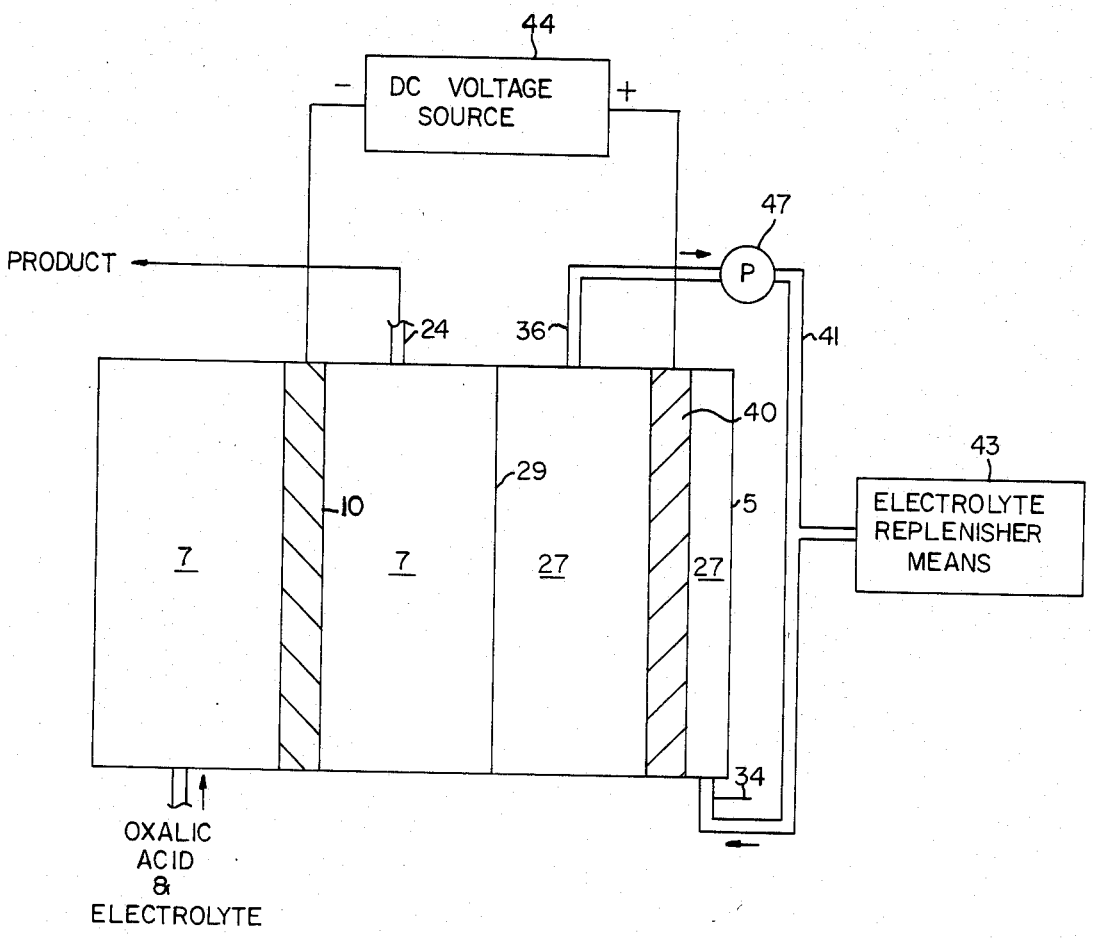
44
DC VOLTAGE SOURCE
−
+
47
P
PRODUCT
24
36
41
40
43
ELECTROLYTE REPLENISHER MEANS
29
10
5
7
7
27
27
34
OXALIC ACID & ELECTROLYTE

MEANS FOR REDUCING OXALIC ACID TO A PRODUCT

This is a division of application Ser. No. 724,707, filed 4/18/85, now U.S. Pat. No. 4,560,450.

BACKGROUND OF THE INVENTION

Field of the Invention

The present invention relates to electrochemical processes in general and, more particularly, to apparatus and the method for reducing oxalic acid to provide a product.

SUMMARY OF THE INVENTION

Apparatus for reducing oxalic acid to a product includes a cell. A separator which separates the cell into two chambers; a catholyte chamber and an anolyte chamber. Each chamber has an inlet and an outlet. A porous cathode having a catalyst is arranged within the catholyte chamber so that a catholyte entering the inlet of the catholyte chamber will pass through the cathode. A porous anode is arranged within the anolyte section so that an electrolyte entering the inlet of the anolyte section will pass through the anode and exit through the outlet of anolyte section. A source provides the catholyte which is a mixture of oxalic acid and an electrolyte to the inlet of the catholyte chamber while another source provides the electrolyte to the inlet of the anolyte chamber. A d.c. voltage is provided between the cathode and the anode so as to cooperate in the reduction of oxalic acid within the porous cathode to a product which exits the catholyte chamber by way of its outlet.

The objects and advantages of the invention will be described more fully hereinafter from a consideration of the detailed description which follows, taken together with the accompanying drawing wherein one embodiment of the invention is illustrated by way of example. It is to be expressly understood, however, that the drawing is for illustration purposes only and are not to be construed as defining the limits of the invention.

BRIEF DESCRIPTION OF THE DRAWINGS

The FIGURE is a partial schematic and a partial cutaway drawing of apparatus for reducing oxalic acid to provide a product in accordance with one embodiment of the present invention.

DESCRIPTION OF THE INVENTION

With reference to the FIGURE, there is shown vessel 5 having a catholyte chamber 7 receiving an oxalic acid and electrolyte mixture through an inlet 8. A porous cathode 10 is arranged within catholyte chamber 7 so that the oxalic acid-electrolyte mixture passes through it. Catholyte chamber 7 also has an outlet 24 from which a product exits. An anolyte chamber 27 is separated from catholyte chamber 8 by a separator 29. Separator 29 allows transfer of electrons while keeping the electrolytes separate. Anolyte chamber 27 has an inlet 34 and an outlet 36. A porous anode 40 is arranged in anolyte chamber 27 in a manner so that electrolyte entering through inlet 34 passes through anode 40 and leaves via outlet 36 to be returned to inlet 34 via a line 41. An electrolyte replenisher means 43 replenishes the electrolyte in line 41.

A d.c. voltage source 44 has its positive terminal connected to anode 40 and its negative terminal connected to cathode 10 so as to provide a direct current voltage across cathode 10 and anode 40.

Cathode 10 is made of a porous carbon with platinum catalyst ruthenium dioxide on porous titanium deposited on it while anode 40 is a porous dimensionally stable anode such as a titanium substrate with ruthenium dioxide. The aqueous electrolyte is selected from the following group of electrolytes: sulfuric acid, hydrochloric acid and potassium chloride, the product provided is glyoxylic acid.

The glyoxylic acid, if so desired, may be further processed using a second cell arrangement as previously described for cell 5 with the difference being that cathode 10 in the second arrangement has mercury as a catalyst. The product produced from glyoxylic acid is ethylene glycol. If ethylene glycol is desired, it may be produced directly from oxalic acid by providing cathode 10 with both platinum and mercury as catalysts. However, the platinum and mercury must have their own discrete sites on cathode 10 and are not applied homogeneously to cathode 10.

The present invention as hereinbefore described electrochemically reduces oxalic acid to either glyoxylic acid or ethylene glycol.

What is claimed is:

1. Apparatus for reducing oxalic acid to a product comprising:

a cell including a separator for separating the cell into two chambers, a catholyte chamber and an anolyte chamber, each chamber having an inlet and an outlet;

a porous anode arranged within the anolyte section in a manner so that an electrolyte entering through the inlet of the anolyte section will pass through the anode and exit through the outlet of the anolyte section;

means for providing an electrolyte to the inlet of the anolyte chamber in a manner so that it will exit through the outlet of the anolyte chamber;

means for providing a mixture of oxalic acid and an electrolyte to the inlet of the catholyte chamber;

porous cathode means located in the catholyte chamber for reducing the oxalic acid in the oxalic acid-electrolyte mixture to the product within said cathode means when a d.c. voltage provided across the anode and the cathode means, said product exiting the cell by way of the catholyte chamber's outlet; and means for providing a d.c. voltage across the cathode means and the anode so as to cooperate in the reduction of the oxalic acid; and in which the cathode means includes a porous cathode having discrete sites of platinum and mercury as catalysts and the product is ethylene glycol.

2. Apparatus as described in claim 1 in which the electrolyte is selected from the following group of electrolytes: sulfuric acid, hydrochloric acid and potassium chloride.

3. Apparatus as described in claim 1 in which the electrolyte is sulfuric acid.

4. Apparatus as described in claim 1 in which the electrolyte is hydrochloric acid.

5. Apparatus as described in claim 1 in which the electrolyte is potassium chloride.

6. Apparatus for reducing oxalic acid to ethylene glycol comprising:

a cell including a separator for separating the cell into two chambers, a catholyte chamber and an anolyte chamber, each chamber having an inlet and an outlet, a porous anode arranged within the anolyte section in a manner so that an electrolyte entering through the inlet of the anolyte section will pass through the anode and exit through the outlet of the anolyte section;

means for providing an electrolyte to the inlet of the anolyte chamber in a manner so that it will exit through the outlet of the anolyte chamber;

means for providing a mixture of oxalic acid and an electrolyte to the inlet of the catholyte chamber;

cathode means located in the catholyte chamber for reducing the oxalic acid in the oxalic acid-electrolyte mixture to ethylene glycol within said cathode means when a d.c. voltage is provided across the anode and the cathode means, said ethylene glycol exiting the cell by way of the catholyte chamber's outlet; and means for providing a d.c. voltage across the cathode means and the anode so as to cooperate in the reduction of the oxalic acid.

7. Apparatus as described in claim 6 in the cathode means includes a cathode, which is made from porous carbon, and catalysts of platinum and mercury located in discrete sites on the cathode.

8. Apparatus as described in claim 7 in which the electrolyte is selected from the following group of electrolytes: sulfuric acid, hydrochloric acid and potassium chloride.

* * * * *